US011286934B2

(12) United States Patent
Pelikan et al.

(10) Patent No.: US 11,286,934 B2
(45) Date of Patent: Mar. 29, 2022

(54) VACUUM PUMP SYSTEM AND METHOD FOR OPERATING A VACUUM PUMP SYSTEM

(71) Applicant: Leybold GmbH, Cologne (DE)

(72) Inventors: Max Pelikan, Bornheim (DE); Raffaello Ghislotti, Mozzo (IT); Dirk Schiller, Hürth (DE); Daniel Reinhard, Cologne (DE)

(73) Assignee: Leybold GmbH, Cologne (DE)

( * ) Notice: Subject to any disclaimer, the term of this patent is extended or adjusted under 35 U.S.C. 154(b) by 164 days.

(21) Appl. No.: 16/464,721

(22) PCT Filed: Nov. 23, 2017

(86) PCT No.: PCT/EP2017/080191

§ 371 (c)(1),
(2) Date: May 29, 2019

(87) PCT Pub. No.: WO2018/108479

PCT Pub. Date: Jun. 21, 2018

(65) Prior Publication Data

US 2019/0345938 A1 Nov. 14, 2019

(30) Foreign Application Priority Data

Dec. 15, 2016 (DE) ..... 20 2016 007 609.5

(51) Int. Cl.

| | |
|---|---|
| ***F04C 25/02*** | (2006.01) |
| ***F04C 27/02*** | (2006.01) |
| ***F04C 28/02*** | (2006.01) |
| ***F04C 28/08*** | (2006.01) |
| ***F04C 23/00*** | (2006.01) |

(Continued)

(52) U.S. Cl.
CPC ..... *F04C 25/02* (2013.01); *F04B 37/14* (2013.01); *F04B 41/06* (2013.01); *F04C 23/006* (2013.01);

(Continued)

(58) Field of Classification Search
CPC ..... F04B 37/14; F04B 41/06; F04C 23/005; F04C 23/006; F04C 25/02; F04C 27/02
See application file for complete search history.

(56) References Cited

U.S. PATENT DOCUMENTS

| | | | |
|---|---|---|---|
| 3,508,758 | A | 4/1970 | Strub |
| 6,004,109 | A | 12/1999 | Gebele et al. |

(Continued)

FOREIGN PATENT DOCUMENTS

| | | | |
|---|---|---|---|
| CN | 104541061 | A | 4/2015 |
| CN | 104822943 | A | 8/2015 |

(Continued)

OTHER PUBLICATIONS

International Search Report dated Feb. 9, 2018 for PCT application No. PCT/US2017/080191.

*Primary Examiner* — Charles G Freay
(74) *Attorney, Agent, or Firm* — Ohlandt, Greeley, Ruggiero & Perle, LLP

(57) ABSTRACT

A vacuum pump system is provided that includes a main vacuum pump that is connected to a chamber that is to be evacuated. An auxiliary pump is connected to an outlet of the main vacuum pump. Furthermore, a sealing gas supply device is connected to the main vacuum pump. The sealing gas supply device is switched on and off with the aid of a control device as a function of a predetermined control variable. Additionally, a method for controlling the vacuum pump system.

19 Claims, 1 Drawing Sheet

(51) Int. Cl.

| | |
|---|---|
| ***F04B 37/14*** | (2006.01) |
| ***F04B 41/06*** | (2006.01) |
| *F04B 49/06* | (2006.01) |
| *F04D 17/16* | (2006.01) |
| *F04D 19/04* | (2006.01) |

(52) U.S. Cl.
CPC ..... *F04C 27/02* (2013.01); *F04C 28/02* (2013.01); *F04C 28/08* (2013.01); *F04B 49/065* (2013.01); *F04C 23/008* (2013.01); *F04D 17/168* (2013.01); *F04D 19/046* (2013.01)

(56) References Cited

U.S. PATENT DOCUMENTS

| | | | | |
|---|---|---|---|---|
| 6,446,651 | B1 | 9/2002 | Abbel | |
| 6,454,524 | B1 * | 9/2002 | Okada ..... | F04D 19/04 415/116 |
| 9,558,969 | B2 | 1/2017 | Seigeot | |
| 2010/0047080 | A1 | 2/2010 | Bruce et al. | |
| 2012/0219443 | A1 | 8/2012 | Neel | |
| 2015/0152871 | A1 | 6/2015 | Kosters et al. | |
| 2016/0356273 | A1 * | 12/2016 | Calhoun ..... | F04C 18/0215 |

FOREIGN PATENT DOCUMENTS

| | | | |
|---|---|---|---|
| CN | 105484969 | A | 4/2016 |
| DE | 202012002684 | U1 | 6/2013 |
| DE | 202014007963 | U1 | 2/2016 |
| EP | 0752531 | A1 | 1/1997 |
| EP | 0974756 | A2 | 1/2000 |
| EP | 1065385 | A2 | 1/2001 |
| JP | 11-257277 | * | 9/1999 |
| JP | 3494457 | B2 | 2/2004 |
| JP | 2008529472 | | 7/2008 |

* cited by examiner

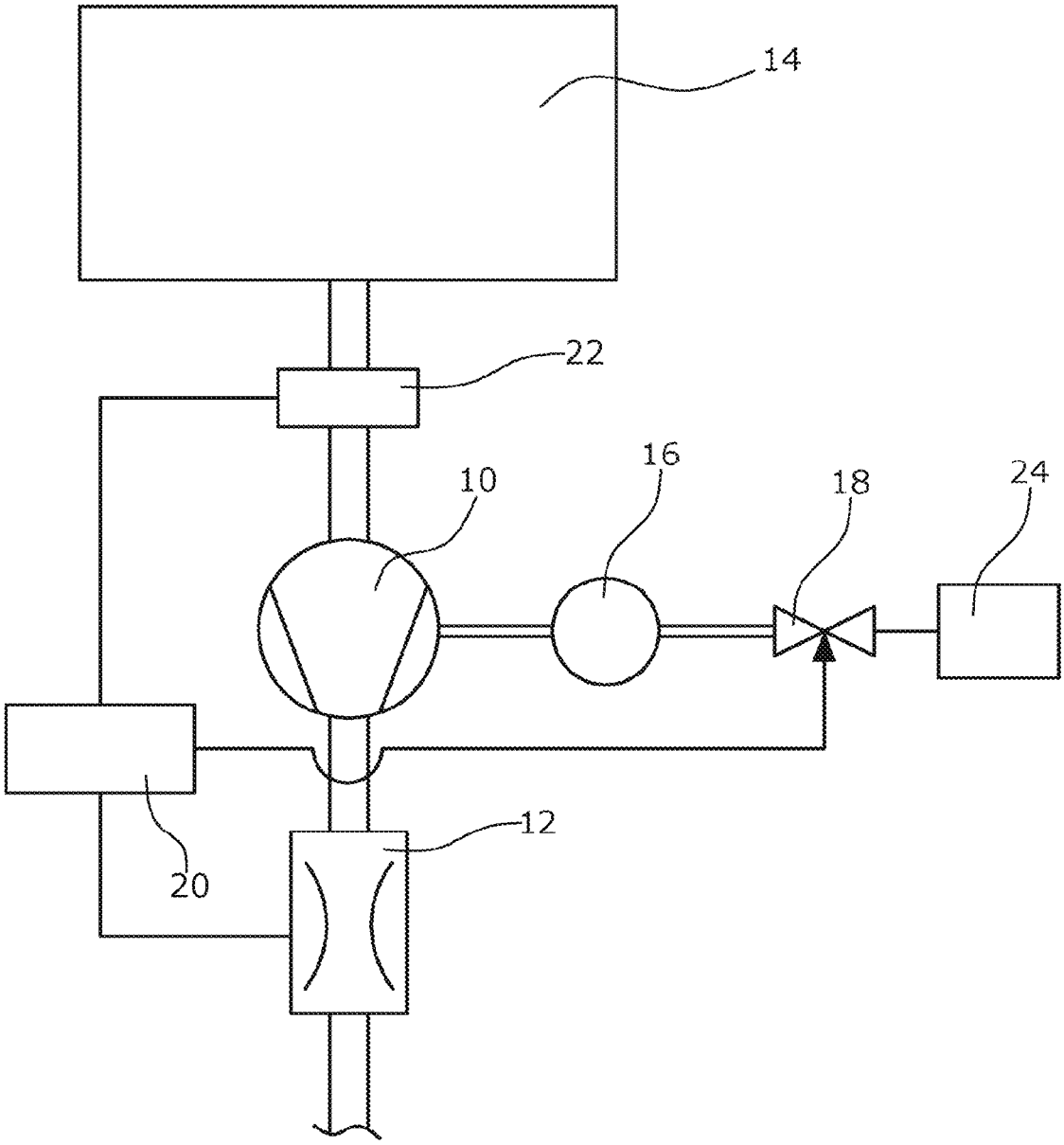
14
22
10
16
18
24
20
12

VACUUM PUMP SYSTEM AND METHOD FOR OPERATING A VACUUM PUMP SYSTEM

BACKGROUND

1. Field of the Disclosure

The disclosure relates to a vacuum pump system and a method for operating a vacuum pump system.

2. Discussion of the Background Art

A vacuum pump system comprises at least one main vacuum pump as well as at least one auxiliary pump, for example. The main vacuum pump is a dry-compression vacuum pump, such as a screw-type vacuum pump, for example. The outlet of the main vacuum pump has connected thereto an auxiliary pump for assisting purposes. As auxiliary pumps membrane pumps or ejector pumps are frequently used. In such vacuum pump systems, the volumetric capacity of the auxiliary pump is considerably smaller than the volumetric capacity of the main vacuum pump. In particular, the volumetric capacity of the auxiliary vacuum pump is smaller than 1/50 of that of the main vacuum pump. The use of such auxiliary pumps allows for attaining lower discharge pressures. The use of such auxiliary pumps allows for reducing the energy consumption of the overall system, wherein the auxiliary pump is disadvantageous in that it consumes additional energy. This is in particular the case when the auxiliary pump, such as the ejector pump, is continuously operated. Further, this results in a high propellant gas consumption of the ejector pump, said propellant gas being compressed air, for example.

From US 2012/0219443 a vacuum pump system having a main pump and an ejector pump connected to the outlet of the main pump is known. In this system the ejector pump is switched on only when a pressure in a predefined pressure range prevails at the outlet of the main vacuum pump. Thereby, the energy consumption of the ejector pump as well as the consumption of propellant gas can be reduced. The ejector pump is turned on and off with the aid of an electronic control device in the vacuum pump system described in US 2012/0219443. Said control device switches the ejector pump as a function of the pressure measured at the outlet of the main vacuum pump and as a function of the power consumption of the main vacuum pump. The vacuum pump system described in US 2012/0219443 is therefore disadvantageous in that a complex electronic control system as well as sensors must be provided. In particular, these are cost-intensive sensors for an absolute pressure measurement. Thus the operational safety is reduced but the manufacturing costs are increased.

Further, from DE 20 2014 007 963 a vacuum pump system is known where a control device for switching on the auxiliary pump, in particular an ejector pump, is provided, wherein this control device exclusively comprises mechanical components. This obviates the need for the use of cost-intensive sensors while ensuring high operational safety even when exclusively mechanical components are used, such that the manufacturing costs are reduced.

Further, in vacuum pump systems sealing gas is frequently supplied to the pump. Sealing gas is in particular used for protecting shaft seals and oil chambers from dust and other particles. The use of sealing gas is however disadvantageous in that an amount of gas entering the vacuum pump must additionally be pumped by the vacuum pump system (ejector). This entails an additional energy demand.

It is an object of the disclosure to provide a vacuum pump system and a method for operating a vacuum pump system, where the energy demand can be reduced even when sealing gas is used.

SUMMARY

The vacuum pump system according to the disclosure comprises a main vacuum pump which is adapted to be connected to a chamber to be evacuated. The main vacuum pump is in particular a dry-compression vacuum pump, such as a screw pump. The outlet of the main vacuum pump has connected thereto an auxiliary pump which, according to a preferred embodiment, is an ejector pump.

In addition, the vacuum pump system comprises a sealing gas supply device as well as a control device connected to the sealing gas supply device. The control device allows for switching the sealing gas supply device on and off. The sealing gas supply device is switched on and off as a function of a predetermined control variable.

The amount of sealing gas may exceed the amount of gas that the ejector can handle, therefore it is absolutely necessary that the sealing gas is cut off for the purpose of evacuating the outlet.

In addition, the control device may be connected to the auxiliary vacuum pump such that the auxiliary vacuum pump can be switched on and off. This is also performed as a function of a control variable.

The control variables used for switching the sealing gas supply device and the auxiliary vacuum pump, respectively, on and off may be different control variables or the same control variable. According to a preferred embodiment, the preferred control variables described below are used both for controlling the auxiliary vacuum pump and for controlling the sealing gas supply device, wherein any combination of the individual control variables is possible such that the control of the sealing gas supply device is performed with the aid of a control variable other than the control variable of the auxiliary vacuum pump.

Preferably, the auxiliary vacuum pump, such as the ejector pump, is preferably switched on only when the main pumping mode is terminated and the vacuum pump system has entered the standby mode (discharge pressure operation). In addition to or instead of this switching of the auxiliary vacuum pump, according to a particularly preferred embodiment, the sealing gas supply is switched off in the standby mode. The auxiliary vacuum pump and/or the sealing gas supply device are therefore preferably switched on as a function of a control variable which defines that the system now goes into the standby mode or the standby mode is imminent or has been left shortly before. Here, as the control variable, a pressure value in the chamber to be evacuated and/or prevailing at the inlet of the main vacuum pump and/or at the outlet of the main vacuum pump may be determined. As soon as this pressure value falls below a predetermined limit value, the auxiliary vacuum pump is switched on. Here, the limit values may differ from each other depending on the arrangement of the pressure sensors with respect to the chamber, the pump inlet or the pump outlet. Also, these values can be combined with each other such that the auxiliary vacuum pump is switched on only when two limit values are not reached at the same time, for example.

In particular, a check valve is provided at the outlet of the main vacuum pump. This check valve is preferably connected to the control device. The position of the check valve can be used as a control variable. Here, the control of the check valve can be determined by a sensor and transmitted to the control device. Preferably, when the check valve is closed, the sealing gas supply device is also closed. According to a preferred embodiment, the auxiliary vacuum pump is then switched on. According to a preferred embodiment, when the check valve is open, the sealing gas is turned on and, preferably, the auxiliary vacuum pump is switched off.

Another possible predetermined control variable is a characteristic variable of an electric motor driving the main vacuum pump. In particular, the power consumption of the electric motor or a signal of a frequency converter is suitable for this purpose. As soon as the power consumption falls below a predetermined limit value, the auxiliary vacuum pump is switched on and/or the sealing gas supply is switched off.

Preferably, the predetermined control variable is a value falling below a pressure value at the main vacuum pump. This pressure value can be determined by a pressure sensor, for example. The corresponding pressure limit value preferably is 1 mbar.

As an additional or alternative control variable, a value falling below a pressure value at the outlet of the main vacuum pump can be used. This pressure value, too, can be determined by a pressure sensor, wherein the pressure limit value preferably is 1020 mbar.

Another, possibly additional control variable may be a characteristic variable of an electric motor driving the main vacuum pump. In particular, this may be the power consumption. Preferably, an increase in the power consumption at the discharge pressure by preferably 10% may serve as the predetermined control variable.

Preferably, the control device comprises an electrically switchable valve or is connected to the latter. Said valve is preferably arranged upstream of the auxiliary vacuum pump. The valve is thus switched when the auxiliary vacuum pump is turned on or off. Of course, this electric valve may be integrated in the vacuum pump.

Likewise, an electrically switchable valve may be provided at a sealing gas inlet. This electrically switchable valve may be part of the control device or connected to the latter such that it is possible to switch the sealing gas supply on or off in a simple manner. Of course, two switchable valves for turning the auxiliary pump on and off as well as switching the sealing gas supply on and off can be provided.

In addition to or instead of an electrically switchable valve, a pressure rocker may be provided. The pressure rocker is connected to corresponding pressure lines such that the pressure rocker is switched as soon as one or a plurality of the pressures defined above fall below or exceed a predetermined limit value. By corresponding switching of the additional pressure rocker, propellant gas is released and thus supplied to the ejector pump. Thus the propellant gas supply to the ejector pump can be switched off. Likewise, a mechanical pressure rocker can switch the sealing gas supply on and off.

With the aid of the vacuum pump system described above the energy consumption can be reduced. In particular, the limit values are selected such that the auxiliary vacuum pump, which is in particular an ejector pump, is not operated in the main pumping mode. In the main pumping mode, during which large amounts of gas are fed, the energy demand of the auxiliary vacuum pump is out of all proportion to the amount of gas fed such that, for reducing the energy demand of the overall system, it is advantageous that the auxiliary vacuum pump remains switched off in the main pumping mode.

In addition, with regard to the sealing gas, the limit values are preferably selected such that in an auxiliary pumping mode no sealing gas is supplied. This can also lead to saving of energy.

In particular, the combination of switching off the seal gas supply in the auxiliary pumping mode and switching off the auxiliary pump in the main switching mode results in a considerable saving of energy.

Further, the disclosure relates to a method for operating a vacuum pump system. Here, this is in particular a vacuum pump system as described above, wherein the method is preferably further developed as described above with reference to the vacuum pump system.

In particular, the method according to the disclosure for operating a vacuum pump system comprises a control device which is connected to the sealing gas supply device and serves for switching the sealing gas supply device off and on as a function of a predetermined control variable. It is further preferred that not only the sealing gas supply device is switched on and off but that additionally the auxiliary pump is switched on and off as a function of a control variable. Here, this may be the same or a different control variable, wherein it is preferred that for switching the sealing gas supply device off and on as well as for switching the auxiliary vacuum pump off and on the same control variable is used.

As described above, in particular according to a preferred embodiment of the vacuum pump system, the sealing gas supply is preferably switched off in the standby mode.

The method according to the disclosure is preferably further developed as described above with reference in particular to a preferred aspect of the vacuum pump system according to the disclosure.

BRIEF DESCRIPTION OF THE DRAWINGS

Hereunder the disclosure is explained in detail on the basis of a preferred embodiment with reference to the accompanying drawing in which:

The FIGURE shows a schematic diagram of a vacuum pump system including a control device.

DETAILED DESCRIPTION OF THE PREFERRED EMBODIMENT

In the illustrated exemplary embodiment, the vacuum pump system comprises a main vacuum pump 10. The outlet of the main vacuum pump 10 is connected to an auxiliary vacuum pump 12 which is in particular an ejector pump. The inlet of the main vacuum pump 10 is connected to a chamber 14 to be evacuated. Further, the main vacuum pump 10 has connected thereto a pump 16. The latter is connected to a container 24 via a controllable valve 18, in which container sealing gas is provided. With the aid of the pump 16 sealing gas is thus supplied to the main vacuum pump 10. If the sealing gas is pressurized the pump 16 may be omitted.

In the illustrated exemplary embodiment, a control device 20 is connected to a pressure sensor 22 arranged between the chamber 14 to be evacuated and the main vacuum chamber 10.

The pressure measured by the pressure sensor 22 serves as a control variable for the control device 20. The electric valve 18, via which sealing gas is supplied to the main vacuum pump 10, is controlled as a function of the pressure.

Further, the ejector pump 12 is controlled correspondingly. Here, too, an electric valve, which controls the propellant gas supply to the ejector pump 12, can be controlled.

What is claimed is:

1. A vacuum pump system comprising:

a main vacuum pump adapted to be connected to a chamber to be evacuated, an auxiliary vacuum pump connected to an outlet of said main vacuum pump, a sealing gas supply device, and a control device connected to said sealing gas supply device for switching said sealing gas supply device off and on as a function of a predetermined control variable, wherein the predetermined control variable for the sealing gas device is a characteristic value of an electric motor driving the main vacuum pump, wherein the characteristic value is a power consumption.

2. The vacuum pump system according to claim 1, wherein the control device is connected to the auxiliary vacuum pump for switching said auxiliary vacuum pump off and on as a function of the predetermined control variable or a different control variable.

3. The vacuum pump system according to claim 1, further comprising a second predetermined control variable for the sealing gas device that comprises the entering or terminating of a standby mode.

4. The vacuum pump system according to claim 1, further comprising a second predetermined control variable for the sealing gas device that comprises the falling below a pressure value at an inlet of the main vacuum pump, which pressure value is determined with the aid of a pressure sensor, wherein the pressure value is 1 mbar.

5. The vacuum pump system according to claim 1, further comprising a second predetermined control variable for the sealing gas device that comprises the falling below a pressure value at an outlet of the main vacuum pump, which pressure value is determined with the aid of a pressure sensor, wherein the pressure value is 1020 mbar.

6. The vacuum pump system according to claim 1, wherein the control device comprises an electrically switchable valve, wherein the electrically switchable valve is arranged upstream of the auxiliary vacuum pump.

7. The vacuum pump system according to claim 1, wherein the control device comprises an electrically switchable valve, wherein the electrically switchable valve is arranged in a supply line for the sealing gas.

8. The vacuum pump system according to claim 1, further comprising a check valve provided at an outlet of the main vacuum pump, further comprising a second predetermined control variable for the sealing gas device that comprises a position of the check valve.

9. A method for operating a vacuum pump system according to claim 1, wherein said method comprises:

evacuating the chamber via at least the main vacuum pump; and switching the sealing gas supply device off and on with the aid of the control device as a function of the predetermined control variable.

10. The method according to claim 9, further comprising switching the auxiliary vacuum pump off and on as a function of the predetermined control variable or a different control variable.

11. The method according to claim 9, further comprising using, as a second predetermined control variable, a step of an entering or a terminating of a standby mode.

12. The method according to claim 9, further comprising using, as a second predetermined control variable, a pressure value at an inlet of the main vacuum pump, wherein the pressure value is 1 mbar.

13. The method according to claim 9, further comprising using, as a second predetermined control variable, a pressure value at an outlet of the main vacuum pump, wherein the pressure value is 1020 mbar.

14. The method according to claim 9, further comprising controlling, with the aid of the control device, a valve arranged upstream of the auxiliary pump.

15. The method according to claim 9, further comprising controlling, with the aid of the control device, a valve arranged in a supply line for the sealing gas supply device.

16. The method according to claim 9, further comprising using, as a second predetermined control variable, a position of a check valve provided at an outlet of the main vacuum pump.

17. A vacuum pump system comprising:

a main vacuum pump adapted to be connected to a chamber to be evacuated;

an auxiliary vacuum pump connected to an outlet of said main vacuum pump;

a sealing gas supply device;

a control device connected to said sealing gas supply device for switching said sealing gas supply device off and on as a function of a predetermined control variable evacuating the chamber via at least the main vacuum pump;

switching the sealing gas supply device off and on with the aid of the control device as a function of the predetermined control variable; and using, as the predetermined control variable, a characteristic variable of an electric motor driving the main vacuum pump.

18. The method according to claim 17, further comprising switching the auxiliary vacuum pump off and on as a function of the predetermined control variable or a different control variable.

19. The method according to claim 17, further comprising controlling, with the aid of the control device, a valve arranged in a supply line for the sealing gas supply device.

* * * * *